US005838878A

United States Patent [19]

Jané et al.

[11] Patent Number: 5,838,878

[45] Date of Patent: Nov. 17, 1998

[54] PORTABLE QUARTZ HEATER

[75] Inventors: Rodney Jané, Westboro; Arthur Wong, Melrose, both of Mass.

[73] Assignee: Honeywell Consumer Products Inc., Southborough, Mass.

[21] Appl. No.: 381,366

[22] Filed: Jan. 31, 1995

[51] Int. Cl.[6] ..... F24H 3/04

[52] U.S. Cl. ..... 392/376; 392/373

[58] Field of Search ..... 392/376, 375, 392/374, 360, 361, 363–370, 373; D23/328, 335, 340

[56] References Cited

U.S. PATENT DOCUMENTS

| | | | |
|---|---|---|---|
| 2,410,211 | 10/1946 | Gough | 392/376 |
| 2,433,137 | 12/1947 | Marr | 392/376 |
| 3,051,820 | 8/1962 | Krichton | 392/376 |
| 5,381,509 | 1/1995 | Mills | 392/376 |

FOREIGN PATENT DOCUMENTS

| | | | |
|---|---|---|---|
| 716678 | 8/1965 | Canada | 392/376 |
| 1008890 | 5/1957 | Germany | 392/376 |
| 57-150738 | 9/1982 | Japan | 392/376 |
| 58-85022 | 5/1983 | Japan | 392/376 |
| 58-85023 | 5/1983 | Japan | 392/376 |
| 1070206 | 6/1967 | United Kingdom | 392/376 |

*Primary Examiner*—Tu Ba Hoang
*Attorney, Agent, or Firm*—John E. Toupal; Harold G. Jarcho

[57] ABSTRACT

A portable electric heater including a housing having a bottom wall with front and back portions, a rear wall, a pair of side walls each having front and back portions, a top wall with front and back portions, a divider wall having a given area, and a front grill wall. The rear wall, divider wall and back portions of the bottom, side and top walls define a chamber while the divider wall, the front grill wall, and the front portions of the bottom, side and top walls define a cavity horizontally juxtaposed to the chamber. A plurality of elongated quartz heater elements and a temperature sensor are mounted in the cavity, and an electrically energizable fan is mounted in the chamber. Defined in the rear wall are a plurality of inlet openings, and in the divider wall are a plurality of discharge openings having a combined area equal to less than 2.5% of the given area. Limiting the overall area of the discharge openings reduces in the cavity turbulence which can prevent the detection of hot spots by the temperature sensor.

18 Claims, 4 Drawing Sheets

PORTABLE QUARTZ HEATER

BACKGROUND OF THE INVENTION

This invention relates generally to portable electric heaters and, more particularly, to a portable electric heater employing quartz heater elements.

Portable electric heaters are used extensively to provide heating in selected areas. Typically, the fans include one or more heating elements and an electrically energized fan for circulating air over the heating elements and out of a discharge opening into the surrounding environment. One known type of portable electrical heater utilizes quartz heater elements which offer the advantage of providing both convection and radiant heating. However, prior quartz heaters have exhibited an undesirable tendency under certain conditions to experience hot spots of excessive temperature that are difficult to monitor and control. Because of such problems, the use of quartz heaters has been limited.

The object of this invention, therefore, is to provide an improved and safer portable quartz heater.

SUMMARY OF THE INVENTION

The invention is a portable electric heater including a housing having a bottom wall with front and back portions, a rear wall, a pair of side walls each having front and back portions, a top wall with front and back portions, a divider wall having a given area, and a front grill wall. The rear wall, divider wall and back portions of the bottom, side and top walls define a chamber while the divider wall, the front grill wall, and the front portions of the bottom, side and top walls define a cavity horizontally juxtaposed to the chamber. A plurality of elongated quartz heater elements and a temperature sensor are mounted in the cavity, and an electrically energizable fan is mounted in the chamber. Defined in the rear wall are a plurality of inlet openings, and in the divider wall are a plurality of discharge openings having a combined area equal to less than 2.5% of the given area. Limiting the overall area of the discharge openings reduces in the cavity turbulence which can prevent the detection of hot spots by the temperature sensor.

According to one feature of the invention, the heater elements consist of a pair of substantially horizontal, vertically spaced apart heater elements mounted closely adjacent to the divider wall, the temperature sensor is a capillary thermal switch having an actuator tube mounted in an upper portion of the cavity, and all of the discharge openings are aligned in a single, substantially horizontal row substantially mid-way between the heater elements. This featured arrangement enhances the effectiveness of hot spot detection.

According to another feature of the invention, the back portion of the top wall defines vent openings communicating with the chamber. The vent openings prevent the build-up of excessive temperature in the upper portion of the chamber.

According to yet another feature of the invention, the vent openings are arranged in a plurality of rows extending between the side walls. This featured arrangement optimizes the escape of heat from the upper portion of the chamber.

According to still another feature of the invention, the divider wall is provided with a matted finish facing the cavity. The matted finish enhances heat distribution to prevent the occurrence of hot spots in the cavity.

BRIEF DESCRIPTION OF THE DRAWINGS

These and other objects and features of the invention will become apparent upon a perusal of the following description taken in conjunction with the accompanying drawings wherein.

DESCRIPTION OF THE PREFERRED EMBODIMENT

Figure 1:
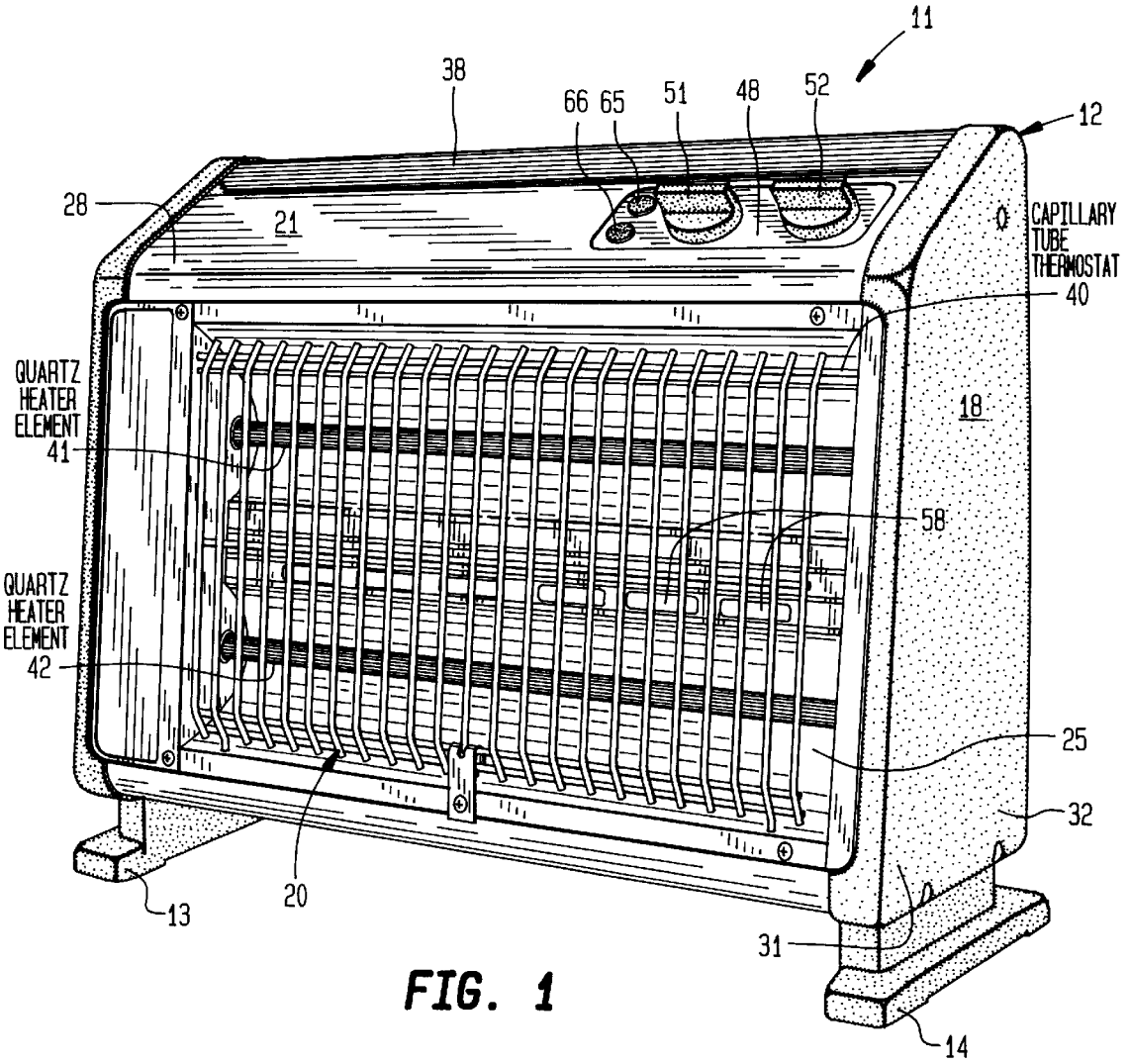
FIG. 1 is a front perspective view of a portable quartz heater according to the invention.
Figure 2:
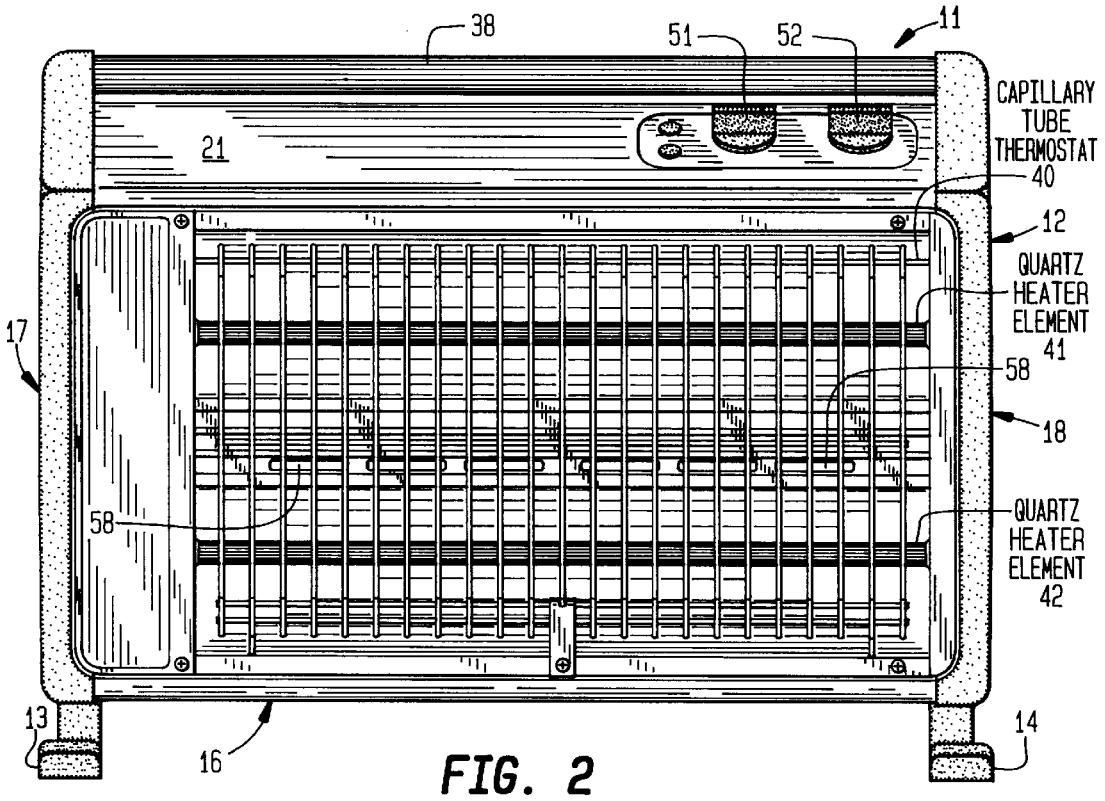
FIG. 2 is a front elevational view of the heater shown in FIG. 1.

A portable electrical heater 11 includes a housing 12 supported by a pair of legs 13, 14. Forming the housing 12 are a bottom wall 16, a pair of sidewalls 17, 18, a front grill wall 20, a top wall 21, a rear wall 22 and a divider wall 25 having a given area. The bottom wall includes a front portion 26 and a back portion 27, the top wall 21 includes a front portion 28 and a back portion 29 and each of the sidewalls 17, 18 includes a front portion 31 and a back portion 32.

Figure 6:
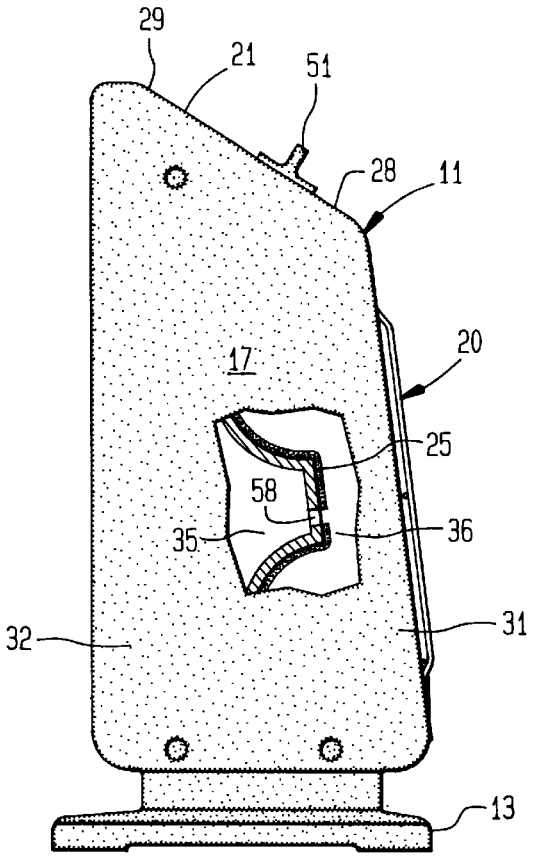
FIG. 6 is a partially cut-away side view of the heater shown in FIG. 1.

The housing 12 forms a chamber 35 (FIG. 6) defined by the rear wall 22, the back portions 32 of the sidewalls 17, 18, the back portion 27 of the bottom wall 16, the back portion 29 of the top wall 21 and the divider wall 25. Also formed by the housing 12 is a cavity 36 defined by the front portion 26 of the bottom wall 16, the front portions 31 of the sidewalls 18, 17, the front portion 28 of the top wall 21, the front grill wall 20 and the divider wall 25. The cavity 36 is horizontally juxtaposed to the chamber 35 and separated therefrom by the divider 25.

Figure 3:
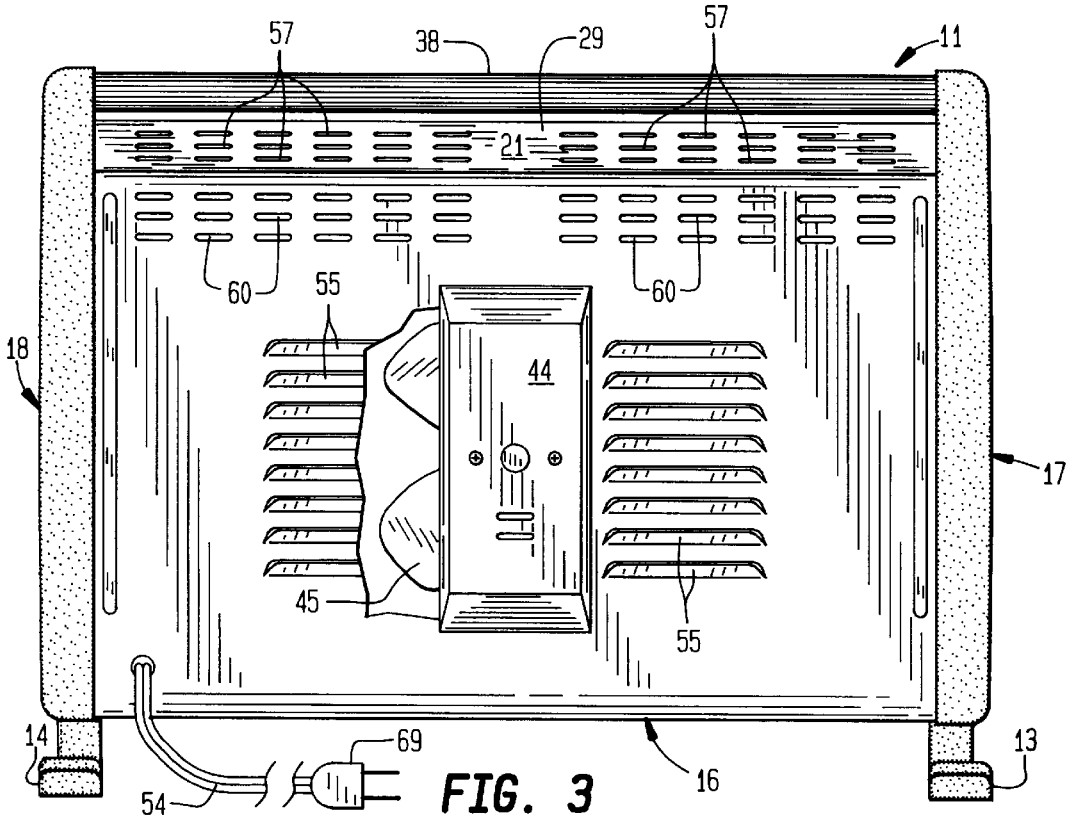
FIG. 3 is a rear elevational view of the heater shown in FIG. 1.
Figure 4:
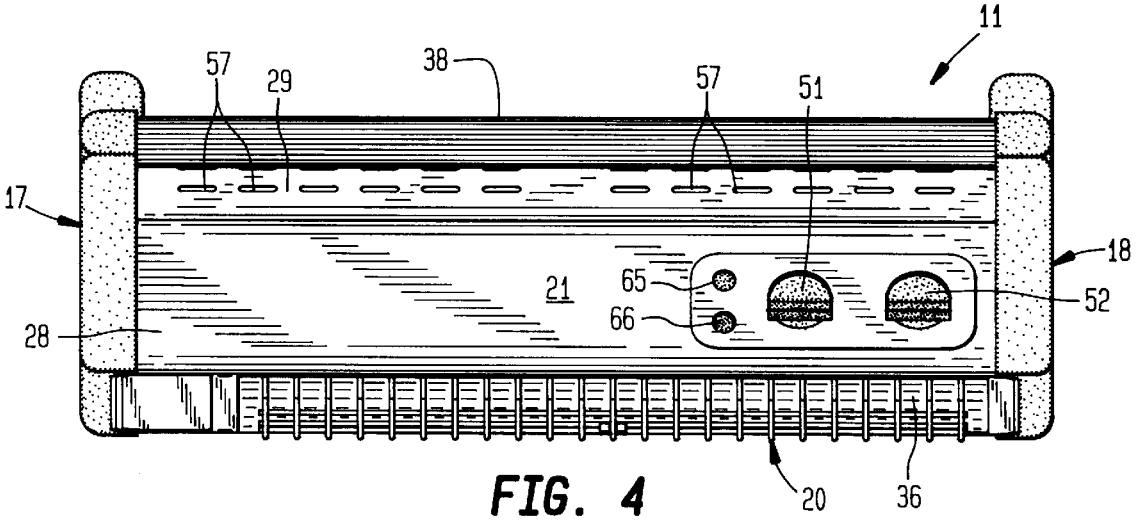
FIG. 4 is a top view of the heater shown in FIG. 1.
Figure 5:
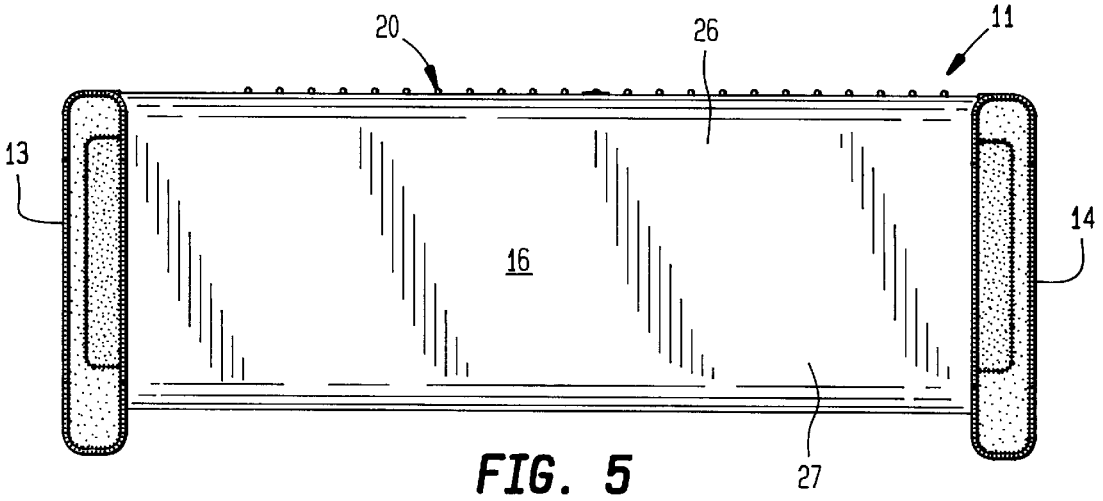
FIG. 5 is a bottom view of the heater shown in FIG. 1.
Figure 7:
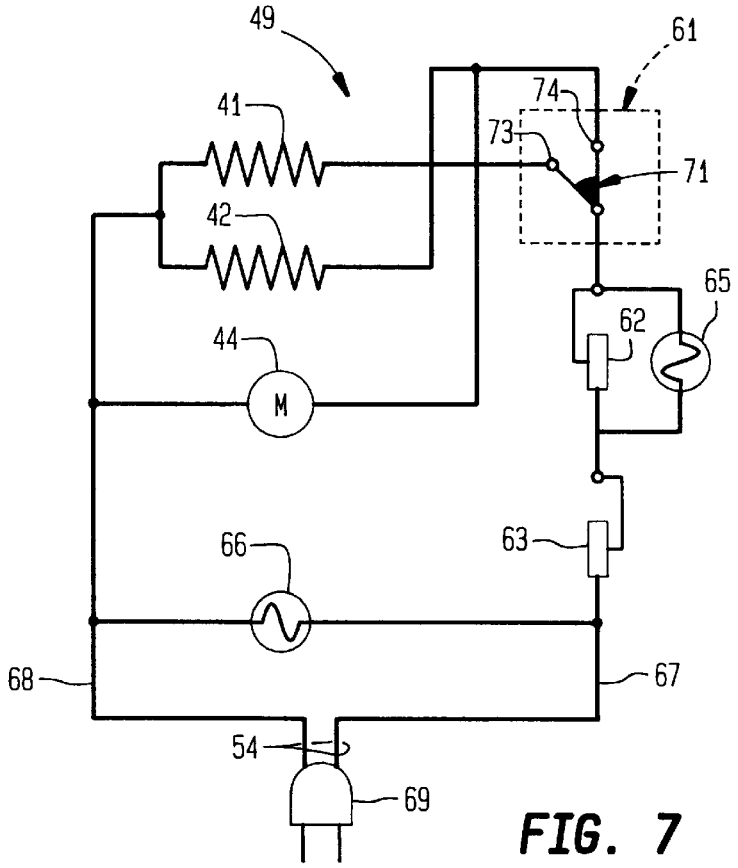
FIG. 7 is a schematic circuit diagram of a control circuit for the heater shown in FIGS. 1–6.

Located within the cavity 36 closely adjacent to the divider wall 25 are a pair of vertically spaced apart, elongated and horizontally oriented quartz heater elements 41, 42. Opposite ends of the heater elements 41, 42 are supported by, respectively, the front portions 31 of the sidewalls 17, 18. A fluid filled capillary tube 40 extends between the sidewalls 17, 18 above the upper heater element 41. Mounted on the rear wall 22 is a motor 44 operatively coupled to a fan blade 45 within the chamber 35. A housing 48 is supported by the front portion 28 of the top wall 21 and retains a control circuit 49 depicted in FIG. 7 and including a pair of actuator switch knobs 51, 52. Power for operating the heater elements 41, 42; the motor 44 and the control circuit 49 is provided by a power cord 54 (FIG. 3).

Communicating with the chamber 35 are a plurality of louvered air inlet openings 55 formed in the rear wall 22 and arranged in vertically oriented rows on opposite sides of the motor 44. Also communicating with the chamber 35 are a plurality of vent openings 57 formed in the back portion 29 of the top wall 21. The vent openings 57 are arranged in a plurality of rows extending between the sidewalls 17, 18. Formed in the divider wall 25 is a horizontally oriented row of discharge openings 58 located approximately midway between the heater elements 41, 42 and extending between the sidewalls 17, 18.

The control circuit 48 includes a two-position switch 61 operated by the knob 51, a thermostatic capillary switch 62 actuated by the tube 40 (FIG. 1) and an adjustable thermostatic control switch 63 operated by the knob 52. Connected in parallel with the capillary switch 62 is a signal lamp 65 while another signal lamp 66 is connected between lines 67 and 68 of the power cord 54.

OPERATION

Insertion of a plug 69 on the cord 54 into a suitable outlet (not shown) provides a voltage across lines 67, 68 to energize the power lamp 66. With the switch 61 in the position shown in FIG. 7, a pair of contacts 71 create a circuit between a power terminal 72 connected to the line 67 and a pair of terminals 73, 74 connected, respectively, to the heater element 41 and the parallel combination of the motor 44 and the heater element 42. Resultant current flow energizes the motor 44 and produces IR heating in the elements 41, 42. The energized motor 44 rotates the fan blade 45 to draw air into the chamber 35 through the inlet openings 55, through the discharge openings 58 and out of the front grill 20 into the surrounding environment. The airflow through the cavity 36 distributes the heat produced by the heater elements 41, 42 to prevent the creation of hot spots. However, in the event that certain conditions such as, for example, an inadvertent obstruction to air flow occurs, excessive heat within the cavity 36 is sensed by the actuator tube 40 to open the capillary switch 62 and interrupt further current flow to the heater elements 41, 42 and the motor 66. In an alternate position of the switch 61, a contact 76 connects only the terminal 73 to the power terminal 72 to provide energization of the motor 44 and heater element 42 while deenergizing the heater element 41. Current flow to the heater elements 41, 42 is controlled by the adjustable thermostat 63 and in response to opening of the capillary switch 62, a sensed excessive heat condition in the cavity 36 is indicated by current flow that energizes the signal lamp 65.

The combined total area of the discharge openings 58 are less than 2.5% of the given area defined by one side of the divider wall 25 and preferably less than 2% thereof. Limiting the combined area of the discharge openings 58 reduces within the cavity 36 air turbulence that can interfere with the operation of the capillary tube 40. In addition, the location of the discharge openings 58 in a horizontal row between the sidewalls 17, 18 and approximately midway between the heater elements 41, 42 helps prevent the occurrence of hot spots within the cavity 36. That result is enhanced also by the provision of a matted finish on the side of the divider wall 25 facing the cavity 36. The matted finish that enhances heat distribution within the cavity 36 by scattering radiar-heat reflected from the divider wall 25. Undesirable overheating of the housing 12 also is prevented by the vent openings 57 which allow escape of heat from the upper portion of the chamber 35.

Obviously, many modifications and variations of the present invention are possible in light of the above teachings. It is to be understood, therefore, that the invention can be practiced otherwise than as specifically described.

What is claimed is:

1. A portable electric heater comprising:

housing means including a bottom wall, a rear wall, a pair of side walls each having front and back portions, a top wall having front and back portions, a divider wall having a given area, and a front grill wall; said rear wall, said divider wall and said back portions of said side and top walls at least partially defining a chamber; and said divider wall, said front grill wall, and said front portions of said side and top walls at least partially defining a cavity horizontally juxtaposed to said chamber;

a plurality of elongated quartz heater elements mounted in said cavity; said heater elements comprising a pair of substantially horizontal, vertically spaced apart heater elements mounted closely adjacent to said divider wall;

temperature sensing means mounted in said cavity; said temperature sensing means comprising a capillary thermal switch having an actuator tube mounted in an upper portion of said cavity adjacent to said front portion of said top wall;

an electrically energizable fan mounted in said chamber;

said rear wall defining a plurality of inlet openings; and said divider wall defining a plurality of discharge openings having a combined area equal to less than 2.5% of the given area.

2. A heater according to claim 1 wherein all of said discharge openings are aligned in a single, substantially horizontal row between said beater elements.

3. A heater according to claim 2 wherein said horizontal row is substantially mid-way between said heater elements.

4. A heater according to claim 3 wherein said combined area is equal to less than 2% of said given area.

5. A heater according to claim 1 wherein said back portion of said top wall defines vent opening means communicating with said chamber.

6. A heater according to claim 5 wherein said vent opening means comprises a plurality of vent openings arranged in a plurality of rows extending between said side walls.

7. A heater according to claim 6 wherein all of said discharge openings are aligned in a single, substantially horizontal row between said heater elements.

8. A heater according to claim 7 wherein said horizontal row is substantially mid-way between said heater elements.

9. A heater according to claim 8 wherein said combined area is equal to less than 2% of said given area.

10. A heater according to claim 5 wherein said divider wall has a matted finish facing said cavity.

11. A heater according to claim 10 wherein said vent opening means comprises a plurality of vent openings arranged in a plurality of rows extending between said side walls.

12. A heater according to claim 11 wherein all of said discharge openings are aligned in a single, substantially horizontal row between said heater elements.

13. A heater according to claim 12 wherein said horizontal row is substantially mid-way between said heater elements.

14. A heater according to claim 13 wherein said combined area is equal to less than 2% of said given area.

15. A heater according to claim 1 wherein said divider wall has a matted finish facing said cavity.

16. A heater according to claim 15 wherein all of said discharge openings are aligned in a single, substantially horizontal row between said heater elements.

17. A heater according to claim 16 wherein said horizontal row is substantially mid-way between said heater elements.

18. A beater according to claim 17 wherein said combined area is equal to less then 2% of said given area.

* * * * *

UNITED STATES PATENT AND TRADEMARK OFFICE

CERTIFICATE OF CORRECTION

PATENT NO. : 5,838,878
DATED : November 17, 1998
INVENTOR(S) : Rodney Jané, Arthur Wong It is certified that error appears in the above-identified patent and that said Letters Patent is hereby corrected as shown below:

Column 3, line 42, "radiar-" should read --radiant--.

Column 4, line 19, "beater" should read --heater--.

Column 4, line 59, "beater" should read --heater--.

Signed and Sealed this

Twenty-second Day of June, 1999

*Attest:*

Q. TODD DICKINSON

*Attesting Officer*

*Acting Commissioner of Patents and Trademarks*